US008711043B2

(12) United States Patent
Chen et al.

(10) Patent No.: US 8,711,043 B2
(45) Date of Patent: Apr. 29, 2014

(54) WIDEBAND ANTENNA

(75) Inventors: Liang-Kai Chen, Hsinchu (TW); Ching-Chia Mai, Hsinchu (TW); Cheng-Han Lee, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 158 days.

(21) Appl. No.: 13/409,042

(22) Filed: Feb. 29, 2012

(65) Prior Publication Data

US 2013/0176178 A1 Jul. 11, 2013

(30) Foreign Application Priority Data

Jan. 9, 2012 (TW) ..... 101100861 A

(51) Int. Cl.
*H01Q 1/24* (2006.01)
*H01Q 5/00* (2006.01)
*H01Q 13/10* (2006.01)

(52) U.S. Cl.
CPC ..... *H01Q 1/243* (2013.01); *H01Q 5/0062* (2013.01); *H01Q 13/10* (2013.01)
USPC ..... 343/702; 343/700 MS

(58) Field of Classification Search
CPC ..... H01Q 1/243; H01Q 5/0062; H01Q 13/10
USPC ..... 343/700 MS, 702
See application file for complete search history.

(56) References Cited

U.S. PATENT DOCUMENTS

| | | | | |
|---|---|---|---|---|
| 7,612,725 | B2 * | 11/2009 | Hill et al. | 343/702 |
| 7,916,089 | B2 * | 3/2011 | Schlub et al. | 343/702 |
| 2005/0088351 | A1 * | 4/2005 | Tai et al. | 343/702 |
| 2005/0110692 | A1 * | 5/2005 | Andersson | 343/702 |
| 2009/0174611 | A1 * | 7/2009 | Schlub et al. | 343/702 |
| 2011/0316751 | A1 * | 12/2011 | Jarvis et al. | 343/702 |
| 2012/0154222 | A1 * | 6/2012 | Oh et al. | 343/702 |

* cited by examiner

*Primary Examiner* — Hoanganh Le
(74) *Attorney, Agent, or Firm* — Winston Hsu; Scott Margo

(57) ABSTRACT

A wideband antenna for a wireless communication device includes a grounding element, a radiating element, extending in a first direction, for transmitting and receiving wireless signals, a feed-in terminal electrically connected to the radiating element, for transmitting a feed-in signal to the radiating element, and a first parasitic radiating element, extending in the first direction, having a side separated from a side of the radiating element by a first distance, and another side separated from the grounding element by a second distance. The first distance allows the first parasitic radiating element and the radiating element to generate a coupling effect to form a slot antenna for transmitting and receiving wireless signals, and the second distance allows the first parasitic radiating element and the grounding element to generate a coupling effect to form a coupling path to the grounding element to increase bandwidth.

11 Claims, 9 Drawing Sheets

WIDEBAND ANTENNA

BACKGROUND OF THE INVENTION

1. Field of the Invention

The present invention relates to a wideband antenna, and more particularly, to a wideband antenna utilizing an interval-designated radiating element to form a slot antenna to increase operating bandwidth and comply with a product mechanism.

2. Description of the Prior Art

An antenna is used for transmitting or receiving radio waves, to communicate or exchange wireless signals. An electronic product with a wireless communication function, such as a laptop, a personal digital assistant (PDA), usually accesses a wireless network through a built-in antenna. However, with advances in wireless communication technology, operating frequencies of different wireless communication systems may be different, and thereby, an ideal antenna should cover bandwidths required for different wireless communication networks with a single antenna. Besides, for meeting the trends of compact portable wireless communication devices within a permitted range, the ideal antenna should have not only a wide bandwidth but also a small size for integration into a portable wireless communication device.

Today, most of the portable wireless communication devices use metal shells or frames to provides aesthetics, durability, etc. Therefore, the antenna may suffer problems of reduced efficiency or instability when integrated into the portable wireless communication device. In such a condition, antenna designers not only face the challenge of providing the wide bandwidth, but also must consider integration of the antenna with the metal frame. For example, it is particularly difficult to design an antenna supporting frequency bands of both digital television broadcasting channels in the 470-862 MHz band, and long term evolution (LTE) broadcasting channels in the 698-960 MHz band and the 1710-2700 MHz band in the metal frame environment.

Therefore, it is a common goal in the industry to design a wideband antenna integrated with the metal frame having wideband characteristics, while also meeting space constraints of the wireless communication device.

SUMMARY OF THE INVENTION

It is therefore an objective of the present invention to provide a wideband antenna having wideband characteristics and meet space constraints of a wireless communication device.

The present invention discloses a wideband antenna for a wireless communication device includes a grounding element, a radiating element, extending in a first direction, for transmitting and receiving wireless signals, a feed-in terminal electrically connected to the radiating element, for transmitting a feed-in signal to the radiating element, and a first parasitic radiating element, extending in the first direction, having a side separated from a side of the radiating element by a first distance, and another side separated from the grounding element by a second distance. The first distance allows the first parasitic radiating element and the radiating element to generate a coupling effect to form a slot antenna for transmitting and receiving wireless signals, and the second distance allows the first parasitic radiating element and the grounding element to generate a coupling effect to form a coupling path to the grounding element to increase bandwidth.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
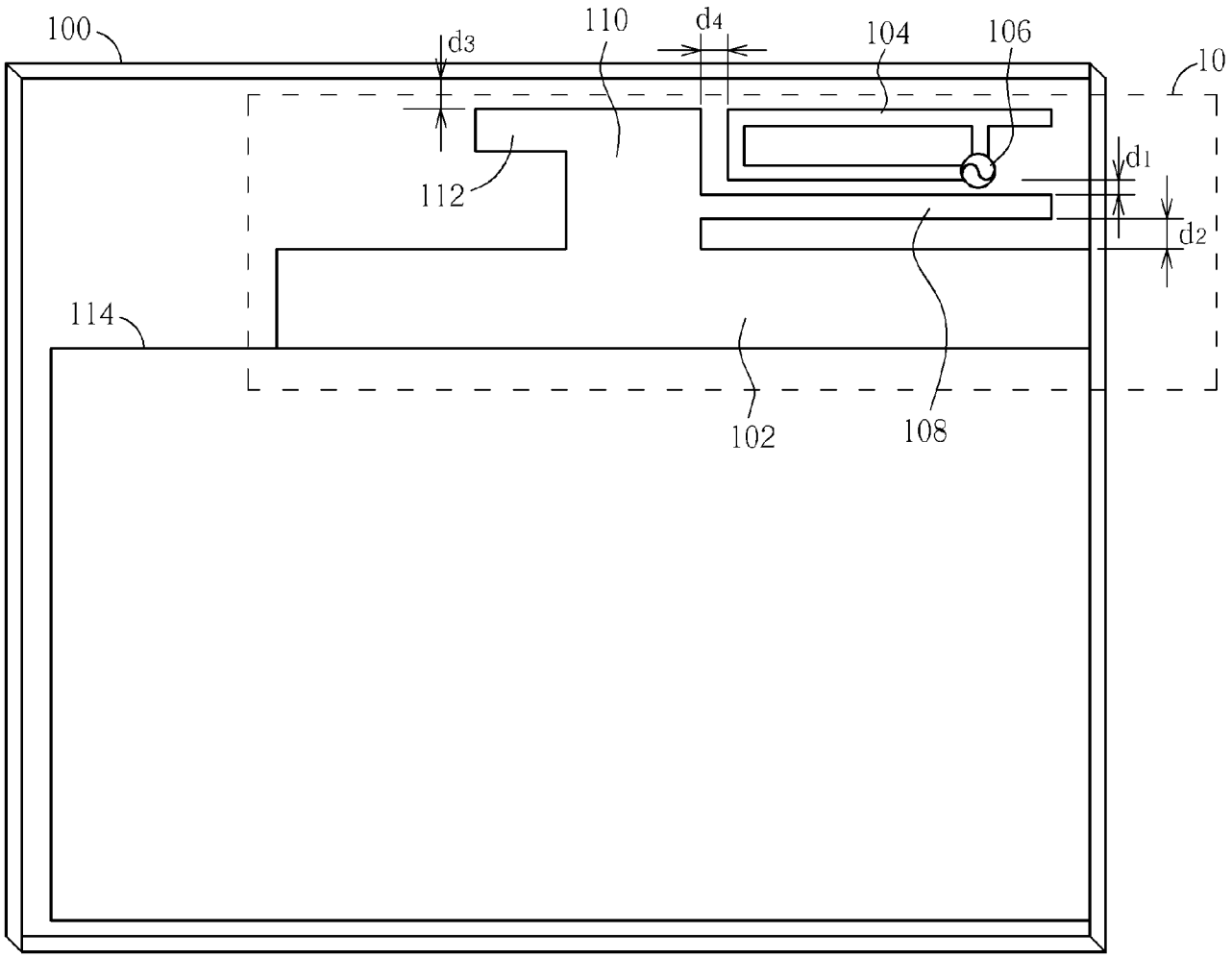
FIG. 1A is a schematic diagram of a wideband antenna according to an embodiment of the present invention.

Please refer to FIG. 1A, which is a schematic diagram of a wideband antenna 10 according to an embodiment of the present invention. As shown in FIG. 1A, the wideband antenna 10 is adapted to a wireless communication device, and can not only integrate with a metal frame 100 of the wireless communication device to have wideband characteristics, but also transmit or receive wireless signals of at least two different bands (such as 470-960 MHz and 1710-2700 MHz). In detail, the wideband antenna 10 includes a grounding element 102, a radiating element 104, a feed-in terminal 106, a parasitic radiating element 108, a connection element 110 and a matching element 112. The grounding element 102 is connected to a system ground 114, for providing grounding. The radiating element 104 is utilized for transmitting and receiving the wireless signals. The feed-in terminal 106 is electrically connected to the radiating element 104 for transmitting a feed-in signal to the radiating element 104. The parasitic radiating element 108, extending in a same direction with the radiating element 104 and electrically connected to the connection element 110, is for transmitting and receiving the wireless signals. The connection element 110 extends in a direction substantially perpendicular to the parasitic radiating element 108 from the grounding element 102, and is further electrically connected to the matching element 112. In addition, a distance d1 separated between the parasitic radiating element 108 and the radiating element 104 forms a slot and allows the parasitic radiating element 108 and the radiating element 104 to generate a coupling effect to form a slot antenna. Besides, a distance d2 separated between the parasitic radiating element 108 and the grounding element 102 allows the parasitic radiating element 108 and the grounding element 102 to generate the coupling effect to form a coupling path to the grounding element from the parasitic radiating element 108 to the grounding element 102. A distance d3 separated between the metal frame 100 and the radiating element 104, the connection element 110 and the matching element 112 allows the metal frame 100 and the radiating element 104, the connection element 110 and the matching element 112 to generate the coupling effect. Therefore, current paths generated by coupling effects between elements can further increase bandwidth, and wideband effects can be achieved as well.

In short, the radiating element 104 and the parasitic radiating element 108 of the wideband antenna 10 are utilized for receiving and transmitting wireless signals of (relatively) high frequencies, and the distance d1 separated between the parasitic radiating element 108 and the radiating element 104 can generate the effect of a slot antenna for receiving and transmitting wireless signals of (relatively) low frequencies. In addition, by coupling effects of the parasitic radiating element 108 and the grounding element 102, the metal frame 100 and the radiating element 104, the connection element 110 and the matching element 112, and the radiating element 104 and the connection element 110, the wideband antenna 10 can resonate to obtain the high-frequency band and the low-frequency band, and thus can increase wideband characteristics to adapt to required communication frequency bands (such as operating bands of DTV, LTE, WWAN, WLAN and WiMAX, etc).

Figure 1B:
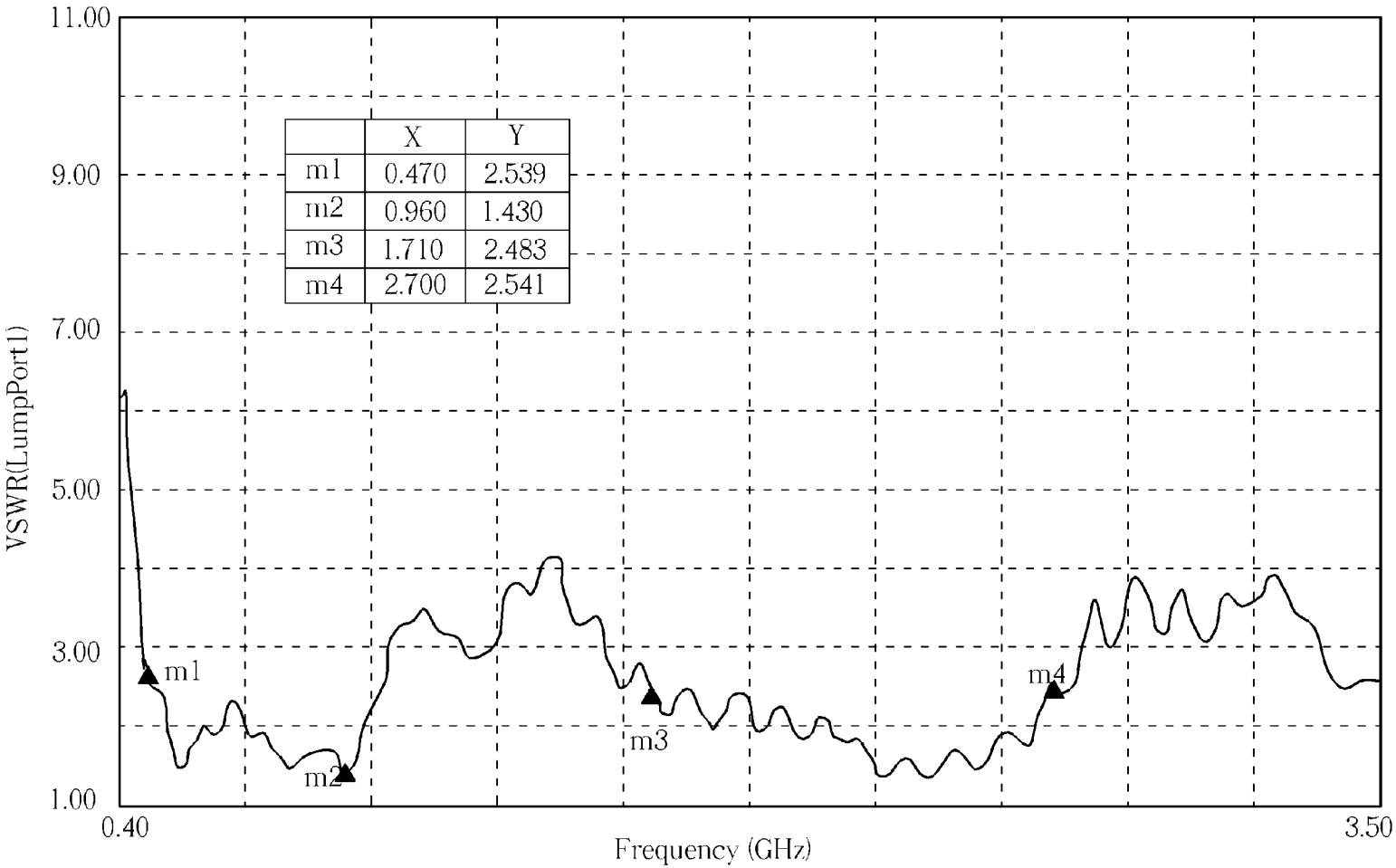
FIG. 1B is a schematic diagram of voltage standing wave ratio (VSWR) of the wideband antenna shown in FIG. 1A.

Please continue to refer to FIG. 1B, which is a schematic diagram of voltage standing wave ratio (VSWR) of the wideband antenna 10 shown in FIG. 1A. As can be seen from FIG. 1B, by utilizing the coupling effects between the elements, the wideband antenna 10 can achieve wideband requirements, and more importantly, can meet space constraints of the wireless communication device.

Note that, FIG. 1A is utilized for illustrating the concept of the present invention, and those skilled in the art may make alterations or modifications according to the concept of the present invention, and is not limited to this. For example, the metal frame 100 is preferably a part of a housing of the wireless communication device and connected to a ground of the wireless communication device to form a coupling path to the grounding element to increase bandwidth, thus length of the metal frame 100 is not limited. In addition, magnitude of the distance d1 should allow the parasitic radiating element 108 and the radiating element 104 to generate the coupling effect to form the slot antenna, and similarly, magnitudes of distances d2, d3 and d4 should also allow the related elements to generate the coupling effects. For example, the distance d1 can be 1-2 mm, and the distances d2, d3 and d4 can be 3 mm, without limitation thereto, and alterations or modifications may be made according to different embodiments.

Figure 2:
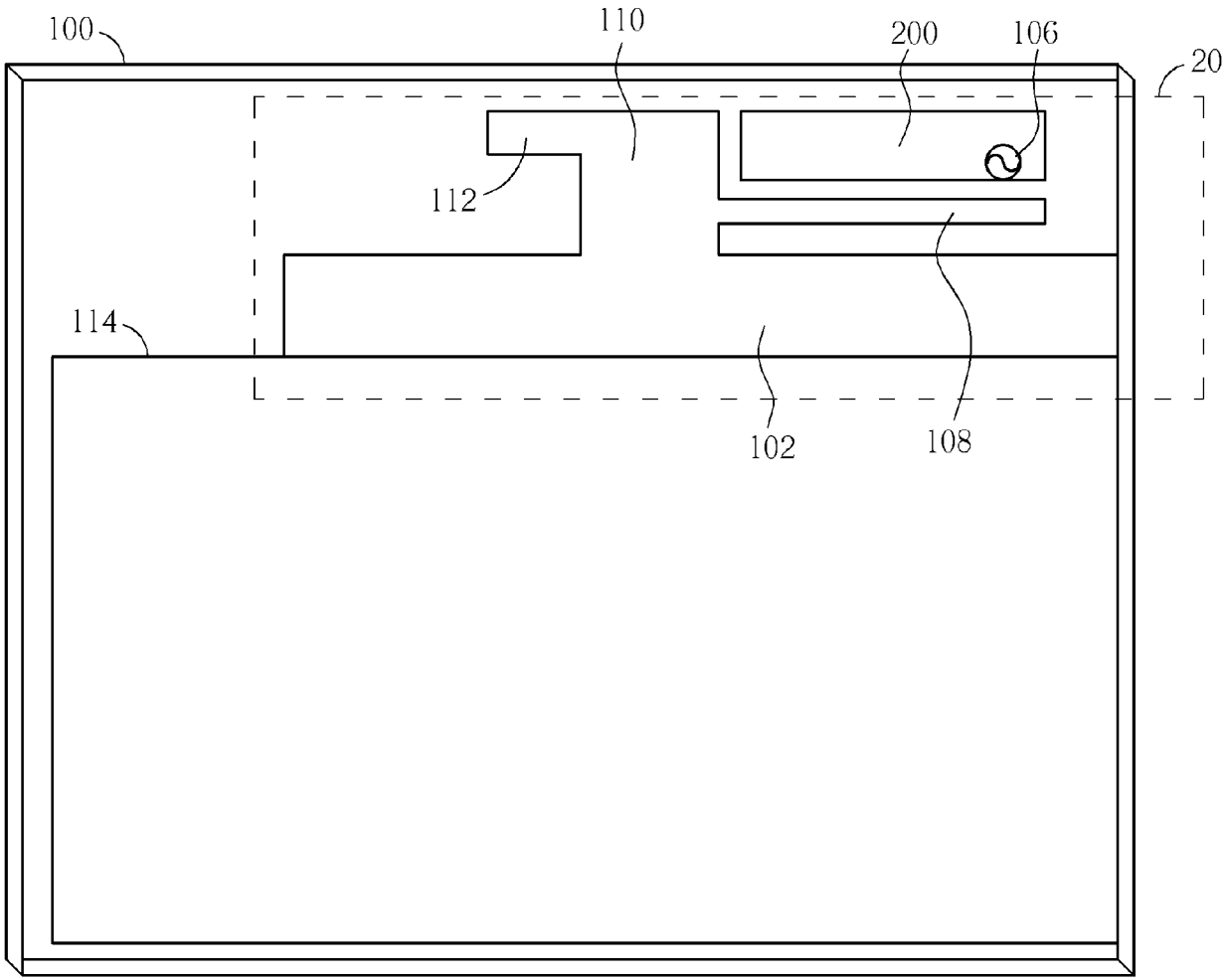
FIG. 2 to FIG. 8 are schematic diagrams of wideband antennas according to different embodiments of the present invention.
Figure 3:
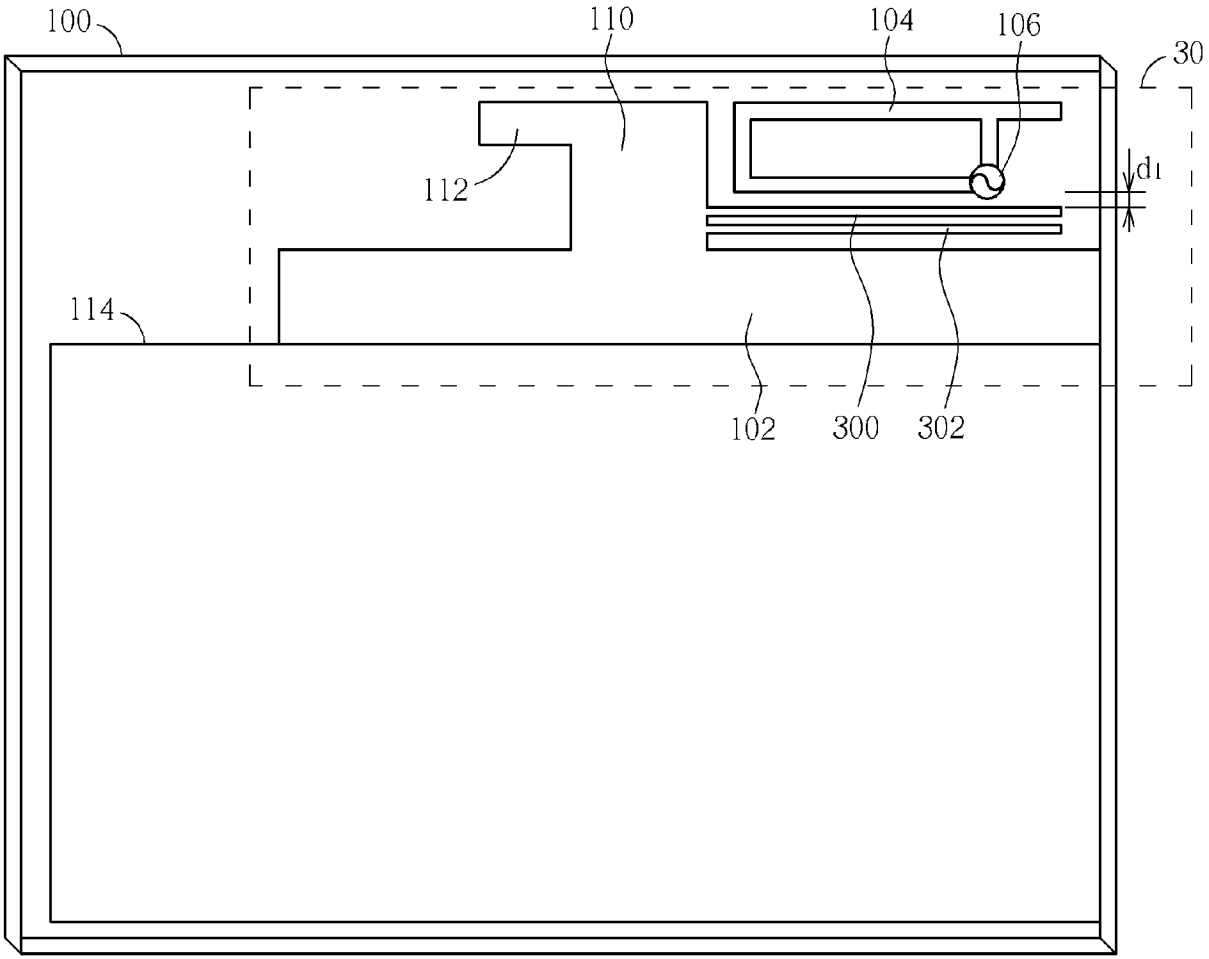
Figure 4:
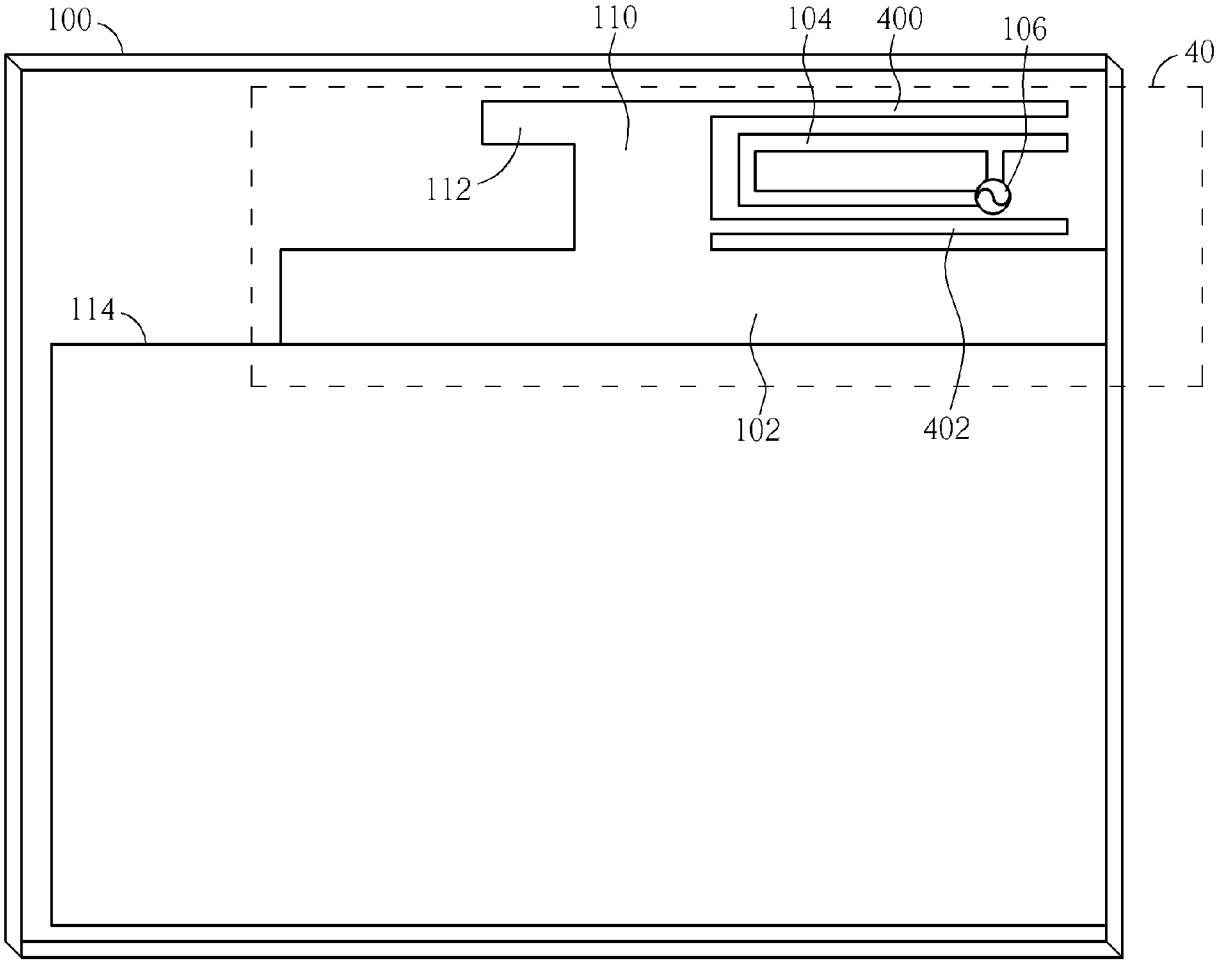

In addition, shape of the radiating element 104 and number, position, etc. of the parasitic radiating element 108 are not limited, thus those skilled in the art may make alterations or modifications according to the concept of the present invention to meet system requirements. For example, please refer to FIG. 2 to FIG. 4, which are schematic diagrams of wideband antennas 20, 30 and 40 according to the embodiments of the present invention. Structures of the wideband antennas 20, 30 and 40 are similar to that of the wideband antenna 10, and thus the same elements are denoted by the same symbols. A difference between the wideband antenna 20 and the wideband antenna 10 is that shape of a radiating element 200 of the wideband antenna 20 is a rectangle (another plane or geometric shape can also be adapted to the present invention). A difference between the wideband antenna 30 and the wideband antenna 10 is that the wideband antenna 30 replaces the parasitic radiating element 108 with parasitic radiating elements 300 and 302, and both of the parasitic radiating elements 300 and 302 are electrically connected to the connection element 110 and are in parallel with the radiating element 104. In detail, the parasitic radiating element 300 is also separated from the radiating element 104 by the distance d1 to generate the effects of the slot antenna. Simultaneously, the parasitic radiating element 300 can generate the coupling effect with the parasitic radiating element 302, and the parasitic radiating element 302 can also generate the coupling effect with the grounding element 102, and form a coupling path to the grounding element from the parasitic radiating element 300 to the parasitic radiating element 302 and to the grounding element 102, so as to increase bandwidth. On the other hand, as shown in FIG. 4, similar to the wideband antenna 30 replacing the parasitic radiating element 108 of the wideband antenna 10 with two parasitic radiating elements, the wideband antenna 40 respectively disposes parasitic radiating elements 400 and 402 between the radiating element 104 and the metal frame 100 and the grounding element 102 in parallel, both of which are electrically connected to the connection element 110, which belongs to structure of the present invention, and can also be integrated with the metal frame of the wireless communication device and generate wideband effects.

Figure 5:
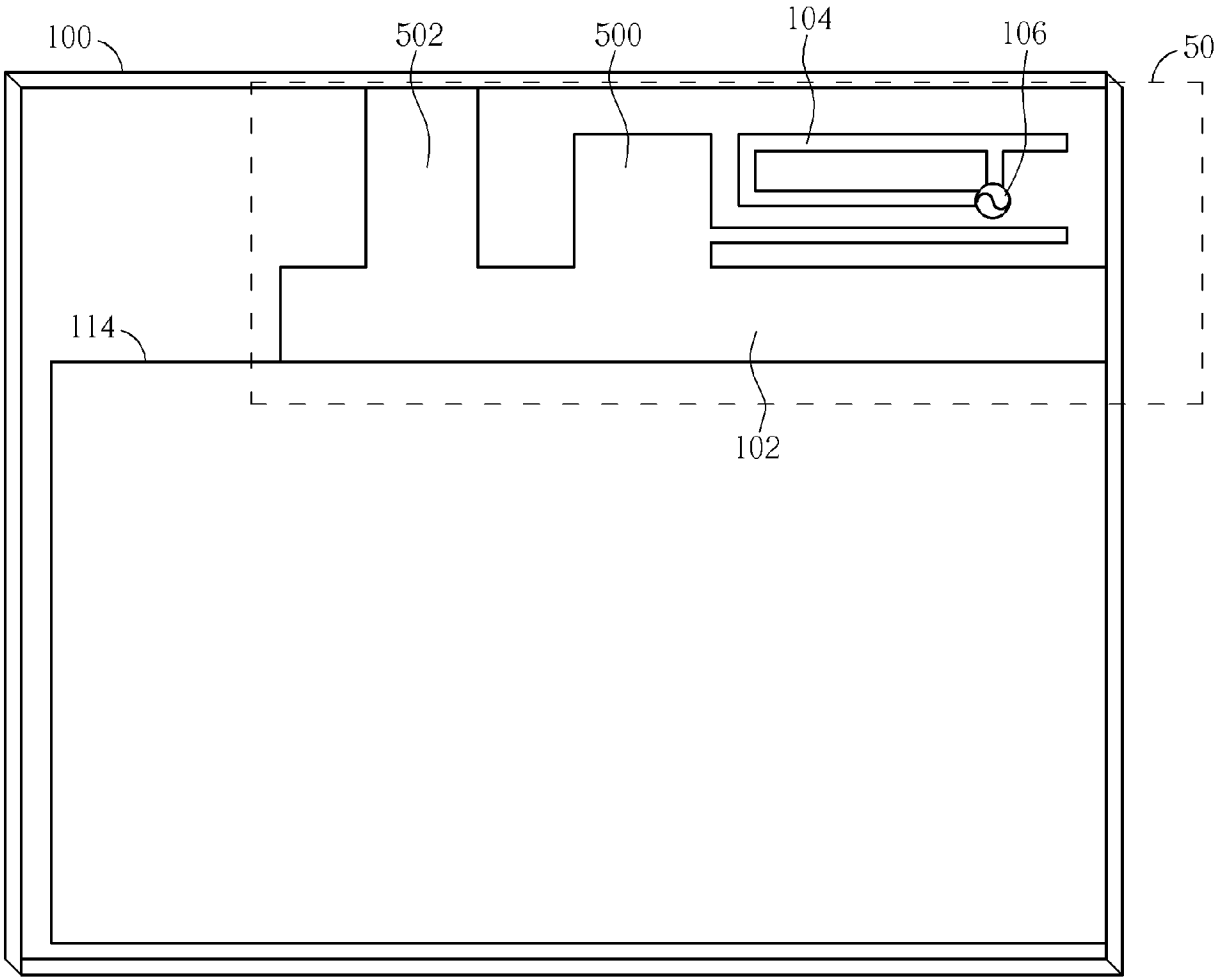
Figure 6:
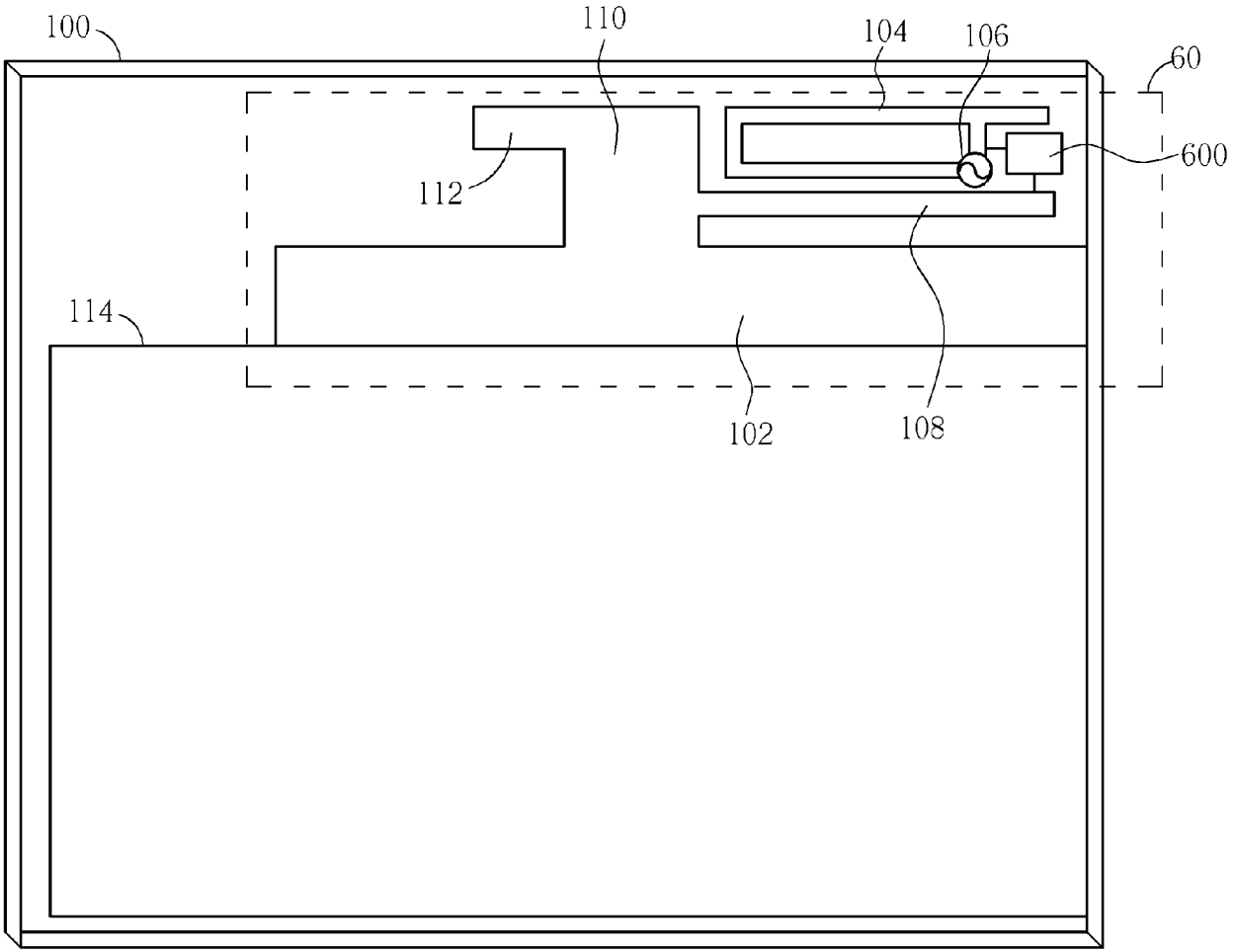

Besides, as those skilled in the art recognized, operating frequencies of an antenna are related to current routes within the antenna; thus, a designer should properly adjust the dimensions, materials, etc. of the wideband antenna 10, or add matching elements to the wideband antenna 10 according to required operating frequencies to meet requirements of different systems. For example, please refer to FIG. 5 and FIG. 6, which are schematic diagrams of wideband antennas 50 and 60 according to the embodiments of the present invention. Structures of the wideband antennas 50 and 60 are similar to that of the wideband antenna 10, and thus the same elements are denoted by the same symbols. A difference between the wideband antenna 50 and the wideband antenna 10 is that a connection element 500 of the wideband antenna 50 does not have an extending matching element (such as the matching element 112 of the wideband antenna 10), and further adds a connection element 502 electrically connected between the grounding element 102 and the metal frame 100. The connection element 502 can generate the coupling effect with the connection element 500 to increase bandwidth. A difference between the wideband antenna 60 and the wideband antenna 10 is that the wideband antenna 60 further adds a matching circuit 600 composed of elements, such as resistors, inductors, capacitors, etc., and electrically connected between the radiating element 104 and the parasitic radiating element 108, for achieving matching, which belongs to structure of the present invention, and can also be integrated with the metal frame of the wireless communication device and generate wideband effects.

Figure 7:
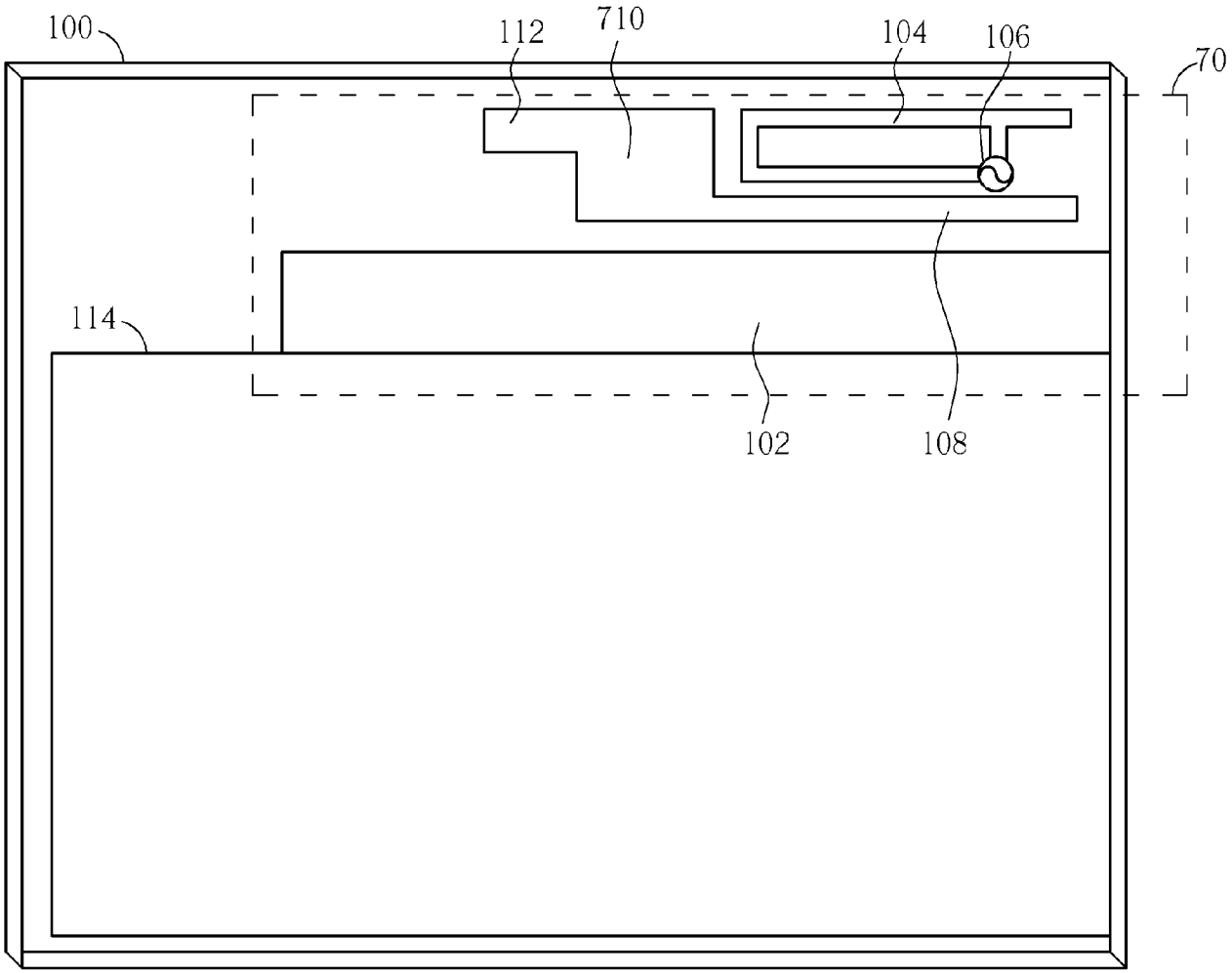
Figure 8:
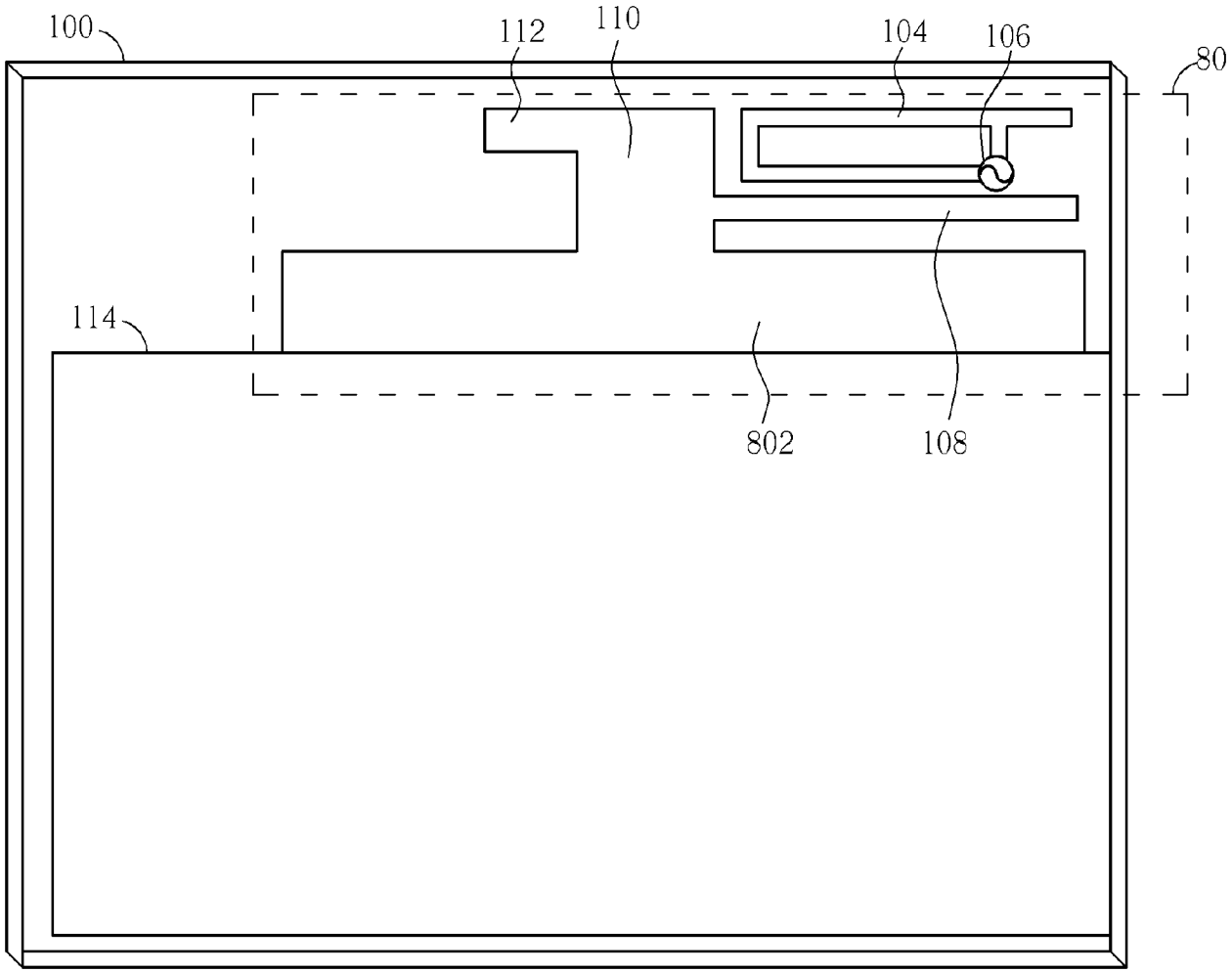

On the other hand, in the above embodiment, the connection element 110 is electrically connected to the grounding element 102, and the grounding element 102 is electrically connected to the metal frame 100. In practice, the connection element 110 can not connect to the grounding element 102, or the grounding element 102 can not connect to the metal frame 100. For example, please refer to FIG. 7 and FIG. 8, which are schematic diagrams of wideband antennas 70 and 80 according to the embodiments of the present invention. Structures of the wideband antennas 70 and 80 are similar to that of the wideband antenna 10, and thus the same elements are denoted by the same symbols. A difference between the wideband antenna 70 and the wideband antenna 10 is that a connection element 710 of the wideband antenna 70 is not electrically connected to the grounding element 102, and a difference between the wideband antenna 80 and the wideband antenna 10 is that a grounding element 802 of the wideband antenna 80 is not electrically connected to the metal frame 100, which belongs to structure of the present invention, and can also be integrated with the metal frame of the wireless communication device and generate wideband effects.

In summary, the slot antenna generated by utilizing an interval-designated radiating element and a parasitic radiating element can increase operating bandwidth, and simultaneously allow integration of the antenna with the metal frame of the communication device. Coupling effects are employed to increase resonant frequency bands, so as to increase antenna bandwidth. The present invention can improve problems of reduced antenna efficiency and instability when the antenna is integrated into the portable wireless communication device, so as to adapt to all kinds of communication frequency bands.

Note that, the abovementioned modifications of the wideband antenna 10 are utilized for illustrating the concept of the present invention, and the material, manufacturing method, shape and position of each component, etc. can be altered according to different requirements, and are not limited to the configurations described above. With the slot antenna generated by the interval-designated radiating element and the parasitic radiating element, and integrated the antenna into the metal frame of the wireless communication device and employing coupling effects, the present invention can simultaneously improve the reduced antenna efficiency and instability of the prior art, which suffers from the metal frame environment, so as to achieve wideband effects and comply with a product mechanism.

To sum up, the present invention integrates the antenna with the metal frame environment and employs coupling effects, to design the wideband antenna having wideband characteristics, as well as meet the space constraints of the wireless communication device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wideband antenna for a wireless communication device, comprising:

a grounding element;

a radiating element, extending in a first direction, for transmitting and receiving wireless signals;

a feed-in terminal electrically connected to the radiating element, for transmitting a feed-in signal to the radiating element; and a first parasitic radiating element, extending in the first direction, having a side separated from a side of the radiating element by a first distance, and another side separated from the grounding element by a second distance, and the feed-in terminal and the grounding element are substantially separated by at least the first parasitic radiating element;

wherein the first distance allows the first parasitic radiating element and the radiating element to generate a coupling effect to form a slot antenna for transmitting and receiving wireless signals, and the second distance allows the first parasitic radiating element and the grounding element to generate a coupling effect to form a coupling path to the grounding element to increase bandwidth.

2. The wideband antenna of claim 1, further comprising a connection element electrically connected to the first parasitic radiating element, extending in a second direction, and having a side separated from another side of the radiating element by a designated distance, the designated distance allowing the connection element and the radiating element to generate a coupling effect.

3. The wideband antenna of claim 2, wherein the connection element further electrically connects to the grounding element.

4. The wideband antenna of claim 2, wherein the second direction is substantially perpendicular to the first direction.

5. The wideband antenna of claim 1, further comprising a second parasitic radiating element in parallel with the first parasitic radiating element.

6. The wideband antenna of claim 2, further comprising a matching element electrically connected to the connection element.

7. The wideband antenna of claim 1, further comprising a matching circuit electrically connected between the radiating element and the first parasitic radiating element.

8. The wideband antenna of claim 1, further comprising a metal frame, having a side separated from another side of the radiating element relative to the first parasitic radiating element by a designated distance, the designated distance allowing the metal frame and the radiating element to generate a coupling effect to increase bandwidth.

9. The wideband antenna of claim 8, wherein the metal frame is a part of a housing of the wireless communication device.

10. The wideband antenna of claim 8, wherein the metal frame further electrically connects to the grounding element.

11. The wideband antenna of claim 8, further comprising a connection element electrically connected between the grounding element and the metal frame.

* * * * *